US005234062A

United States Patent [19]

Inoue

[11] Patent Number: 5,234,062

[45] Date of Patent: Aug. 10, 1993

[54] AUTOMATIC EVACUATION DRILLING BUCKET

[76] Inventor: Hachiro Inoue, No. 4-13-10, Kokubun, Ichikawa City, Chiba Prefecture, Japan

[21] Appl. No.: 998,846

[22] Filed: Dec. 30, 1992

[51] Int. Cl.[5] ..... E21B 27/00

[52] U.S. Cl. ..... 175/161; 37/189; 37/347; 37/901

[58] Field of Search ..... 37/80 R, 81, 92, 189, 37/65, DIG. 2; 175/94, 102, 161, 308

[56] References Cited

U.S. PATENT DOCUMENTS

| | | | |
|---|---|---|---|
| 1,713,037 | 5/1929 | Ellis | 37/65 |
| 3,185,226 | 5/1965 | Robbins | 175/161 X |
| 3,876,258 | 4/1975 | Abderhalden | 37/189 X |
| 4,307,525 | 12/1981 | Macoblocki | 37/65 |
| 4,526,242 | 7/1985 | Matthieü et al. | 175/308 X |
| 4,945,661 | 8/1990 | Kuioka et al. | 37/65 X |
| 4,971,163 | 11/1990 | Ohashi et al. | 175/161 X |

FOREIGN PATENT DOCUMENTS

| | | | |
|---|---|---|---|
| 59917 | 12/1990 | Japan . | |
| 1247522 | 7/1986 | U.S.S.R. | 175/308 |

*Primary Examiner*—Dennis L. Taylor
*Assistant Examiner*—J. Russell McBee
*Attorney, Agent, or Firm*—Foley & Lardner

[57] ABSTRACT

An automatic evacuation drilling bucket comprises a follower formed with a working space for receiving a blade member which is capable of coming in contact with an osculating arm, the working space having upper, lower, transition and receiving compartments. If the blade member is located in the upper and lower compartments, the blade member is engaged with the follower when a drive shaft member is rotated in the normal and reverse directions. If the blade member is urged to move into the receiving compartment through the transition compartment, the blade member comes in contact with the osculating arm when the drive shaft member is rotated in the reverse direction.

4 Claims, 10 Drawing Sheets

AUTOMATIC EVACUATION DRILLING BUCKET

BACKGROUND OF THE PRESENT INVENTION

The present invention relates generally to a drilling bucket for excavating the ground on the earth drill method or the like and, more particularly, to an automatic evacuation drilling bucket which can automatically evacuate earth and sand received therein.

The earth drill method is well known, which is one of methods of substructure work wherein a drilling bucket is used to excavate the ground so as to form a hole, earth and sand due to excavation being received therein for evacuation on the ground. FIGS. 13–15 show one of drilling buckets for use in the earth drill method which is disclosed, for example, in JP-B2-59917. Referring to FIG. 13, a drive shaft member, designated generally by reference numeral 101, is connected to a kelly-bar (not shown), and splined to a follower 103 arranged to a support frame portion 102*a* of a bucket main body 102. Referring also to FIG. 14, an operating arm 104 is arranged to the drive shaft member 101, whereas an osculating arm 105 is disposed opposite to the operating arm 104 to be capable of coming in contact therewith, and it is integrally formed with an operating shaft 106 arranged to the bucket main body 102. Arranged to the operating shaft 106 at its lower end is a stop 107 which is detachably engaged with a receiver 109 of a bottom cover 108 which is mounted to the bucket main body 102 in a manner to be capable of opening and closing operation.

Referring to FIGS. 14 and 15, wherein the drive shaft member 101 is rotated by the kelly-bar in the direction of arrow A in FIG. 14 or in the normal direction, earth and sand are excavated by the bucket main body 102, and received within the bucket main body 102 through openings of the bottom cover 108. When evacuating earth and sand within the bucket main body 102 on the ground, the kelly-bar is rotated in the direction opposite to that of arrow A or the reverse direction. Then, due to presence of a play 110 interposed between the drive shaft member 101 and the follower 103 as shown in FIG. 15, the operating arm 104 is rotated from the position as indicated by a fully drawn line to the position as indicated by a one-dotted chain line in FIG. 14, thus rotating the osculating arm 105. At the same time, the operating shaft 106 is rotated, so that the stop 107 is disengaged with the receiver 109 to open the bottom cover 108, evacuating earth and sand within the bucket main body 102. Additionally, also when the drive shaft member 101 is rotated by the kelly-bar in the direction of arrow A in FIG. 14 for quick stoppage, the same operation is made, evacuating earth and sand within the bucket main body 101.

As to the prior art automatic evacuation drilling bucket, when the drive shaft member 101 is rotated in the normal direction to excavate the ground, the operating arm 104 fails to come in contact with the osculating arm 105, so that the operating shaft 106 is not rotated to open the bottom cover 108. However, if the drive shaft member 101 becomes incapable of rotation by encountering in the ground obstacles such as a big rubble, a driftwood, an old pile, a concrete fragment, or that the bucket main body 102 is locked in the hole as excavate by a wall thereof which overhangs the bucket main body 102 due to a soft bed, the drive shaft member 101 may be obliged to rotate in the reverse direction. Then, the operating arm 104 comes in contact with the osculating arm 105 to rotate the operating shaft 106, opening the bottom cover 108. If the bottom cover 108 is opened in the holes as excavated, it functions as an anchor, resulting in difficult lifting of the bucket main body 102 from the hole.

It is, therefore, an object of the present invention to provide an automatic evacuation drilling bucket wherein a bottom cover fails to be opened even when a drive shaft member is rotated in the reverse direction, or with a bucket being suspended.

SUMMARY OF THE INVENTION

According to the present invention, there is provided a drilling bucket including a drive shaft member for receiving a torque from a kelly-bar and a main body mounted to the drive shaft member and having a bottom cover, the drive shaft member being rotatable in a normal direction and a reverse direction, comprising:

a blade member fixedly mounted to the drive shaft member for rotating together;

a follower disposed to the main body, said follower being formed with a space for receiving said blade member;

an arm rotatably mounted to the main body, said arm being capable of coming in contact with said blade member to open the bottom cover of the main body;

first means for allowing an engagement of said blade member with said follower when the drive shaft member is rotated in the normal direction and the reverse direction; and second means for allowing a contact of said blade member with said arm when the drive shaft member is rotated in the reverse direction.

DETAILED DESCRIPTION OF THE INVENTION

Figure 1:
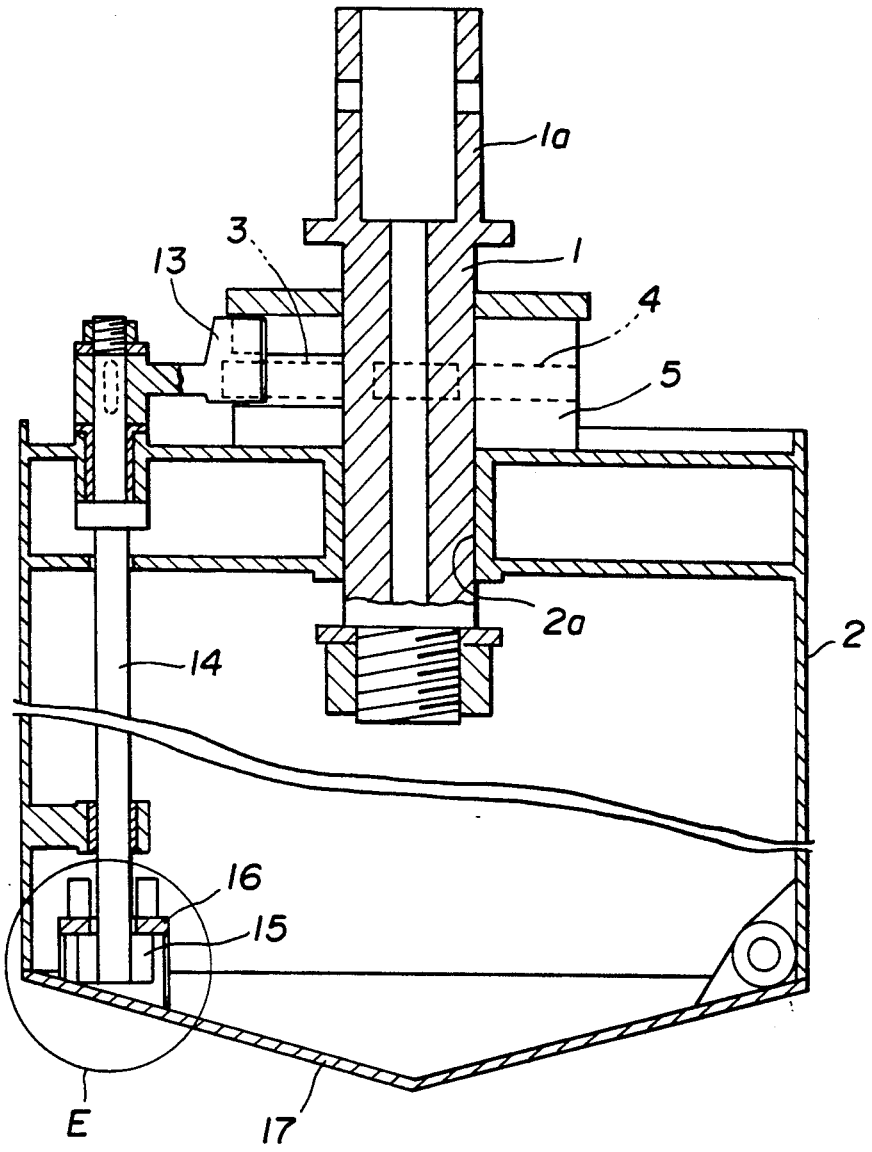
FIG. 1 is a longitudinal section showing a first preferred embodiment of an automatic evacuation drilling bucket according to the present invention.

Referring to FIGS. 1–8, there is shown a first preferred embodiment of an automatic evacuation drilling bucket. Referring particularly to FIG. 1, a drive shaft member, designated generally by reference numeral 1, provides a socket 1*a* with which a substantially square section kelly-bar (not shown) is engaged. The drive shaft member 1 is fitted in a mounting hole 2*a* formed in the center of an upper side of a bucket main body 2. A pair of blade members 3, 4 are fixed to the drive shaft member 1 in the center of its peripheral wall. Additionally, fixed to the bucket main body 2 in the center of its upper side is a follower 5 in which the drive shaft member 1 is rotatably and slidably fitted.

Figure 2:
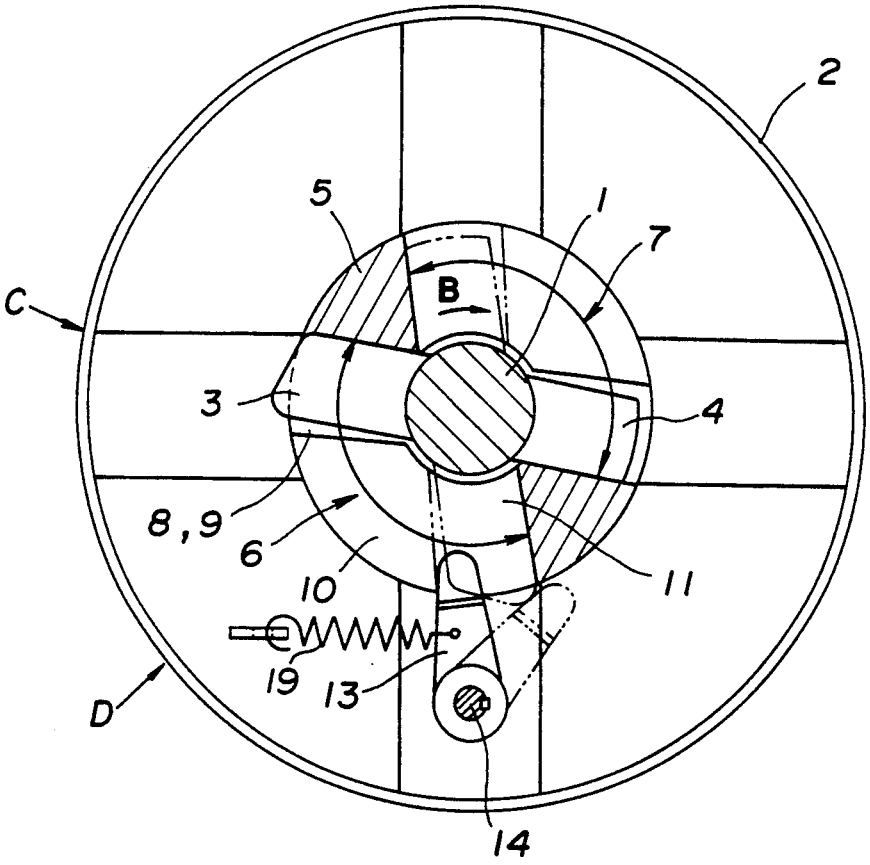
FIG. 2 is a cross section showing the first preferred embodiment of the present invention.
Figure 3:
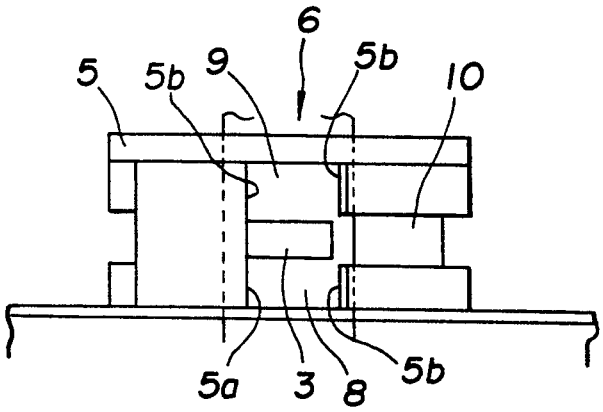
FIG. 3 is a side view of the first preferred embodiment as viewed from arrow C in FIG. 2.

Referring to FIGS. 2 and 3, the follower 5 is formed with a pair of working spaces 6, 7 wherein the pair of blade members 3, 4 are located, respectively.

When pressing down, the drive shaft member 1 slides downward with respect to the follower 5, and at that time, the blade member 3 is also urged to move downward. As best seen in FIG. 3, the working space 6 has a lower compartment 8 in its lower portion to obtain engagement of the blade member 3 with the follower 5 when the blade member 3 is urged to move downward. The blade member 3 located in the lower compartment 8 is constructed to come in contact with first and second stopper walls 5*a*, 5*b*. When the blade member 3 is in contact with the first or second stopper wall 5*a*, 5*b*, rotation of the drive shaft member 1 in the direction of arrow B in FIG. 2, i.e., the normal direction, or in the direction opposite to that, i.e., the reverse direction makes the follower 5 rotate immediately in the normal or reverse direction.

On the other hand, when pulling up the drive shaft member 1, the blade member 3 is urged to move upward. As best seen in FIG. 3, the working space 6 has an upper compartment 9 in its upper portion to obtain engagement of the blade member 3 with the follower 5 when the blade member 3 is urged to move upward. When locating in the upper compartment 9, the blade member 3 also comes in contact with the first or second stopper wall 5*a*, 5*b*, so that the drive shaft member 1 makes the follower 5 rotate in the normal or reverse direction in the same manner.

Figure 4:
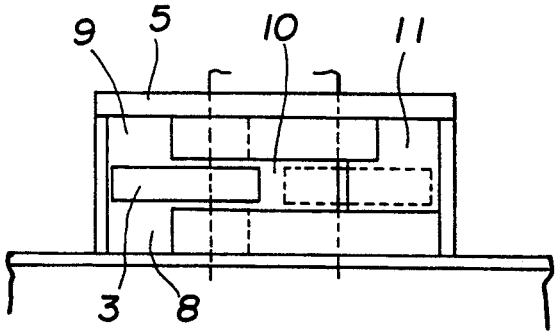
FIG. 4 is a view similar to FIG. 3, but as viewed from arrow D in FIG. 2.

Referring to FIGS. 3 and 4, arranged between the upper and lower compartments 9, 8 of the working space 6 is a transition compartment 10 for allowing the blade member 3 to move in the working space 6 in the direction opposite to that of arrow B in FIG. 2. As best seen in FIGS. 2 and 4 the working space 6 has a receiving compartment (third compartment) 11 corresponding to the direction of this movement.

It is to be noted that the working space 7 has its lower compartment, upper compartment, transition compartment, and receiving compartment.

As best seen in FIG. 2, an osculating arm 13 is disposed on the side of the receiving compartment 11 of the working space 6 to be opposite to the blade member 3, so that when moving into the receiving compartment 11 through the transition compartment 10, an end portion of the blade member 3 protruding from an outer peripheral wall of the follower 5 comes in contact with the osculating arm 13. Since the osculating arm 13 has a thick end portion, the blade member 3 can come in contact with the osculating arm 13 no matter which position the blade member 3 occupies in the receiving compartment 11.

Figure 5:
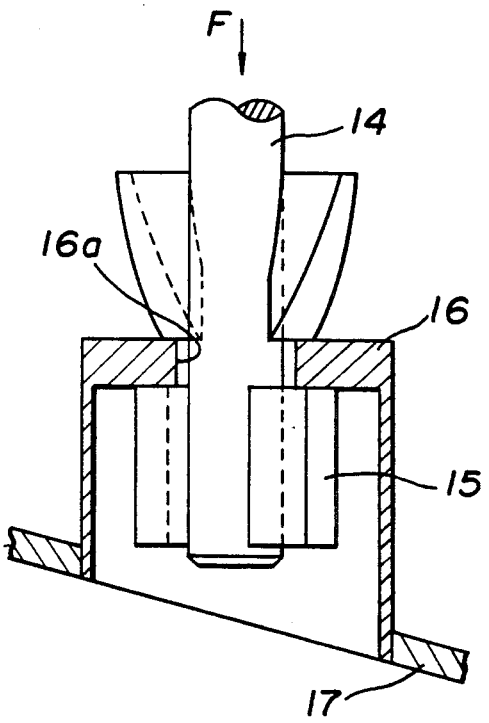
FIG. 5 is an enlarged view showing a portion E in FIG. 1.
Figure 6:
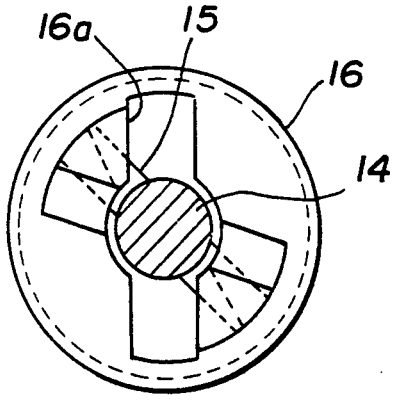
FIG. 6 is a diagrammatic view showing the portion E as viewed from arrow F in FIG. 5.
Figure 7A:
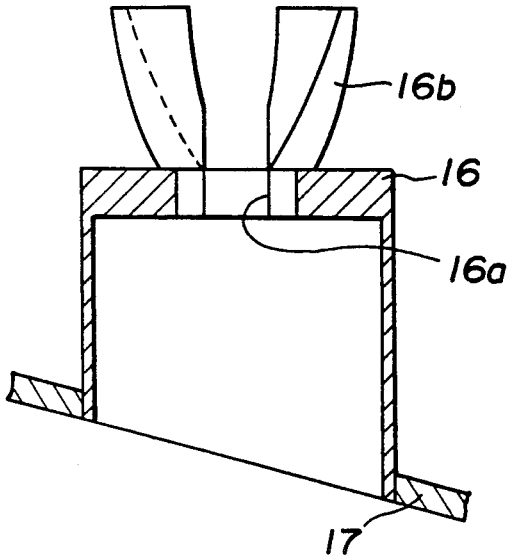
FIG. 7*a* is a view similar to FIG. 5, showing a receiver.
Figure 7B:
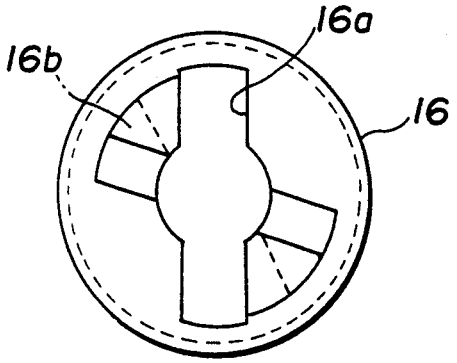
FIG. 7*b* is a view similar to FIG. 6, showing the receiver.

As best seen in FIGS. 1 and 2, the osculating arm 13 is fixed to an operating shaft 14 rotatably supported to the bucket main body 2 at its marginal portion. It is to be noted that the osculating arm 13 always undergoes counterclockwise biasing force. Referring to FIGS. 1 and 5, mounted to the operating shaft 14 at its lower end is a stop 15 which is engaged with a stop hole 16*a* of a receiver 16 as shown in FIGS. 6, 7*a* and 7*b*. The receiver 16 includes a twisted guide portion 16*b*, and it is arranged to a bottom cover 17 mounted to the bucket main body 2 at its bottom in a manner to be capable of opening and closing operation. The operating shaft 14, stop 15, and receiver 17 constitute a lock mechanism for locking the bottom cover 17 to the bucket main body 2. with rotation of the operating arm 14, the stop 15 is disengaged with the receiver 16, allowing the bottom cover 17 to open.

Next, referring particularly to FIG. 8, the operation of the first preferred embodiment will be described. It is to be noted that a description will be made only with regard to the blade member 3 since the blade member 4 operates in the same manner.

Figure 8:
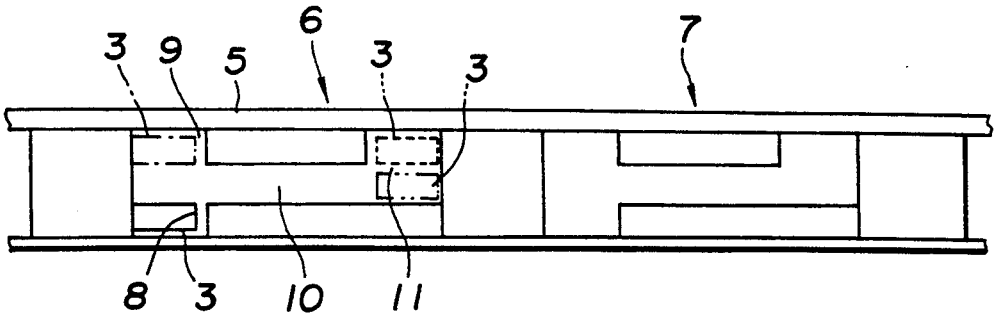
FIG. 8 is a development showing a follower with a blade member.
Figure 9:
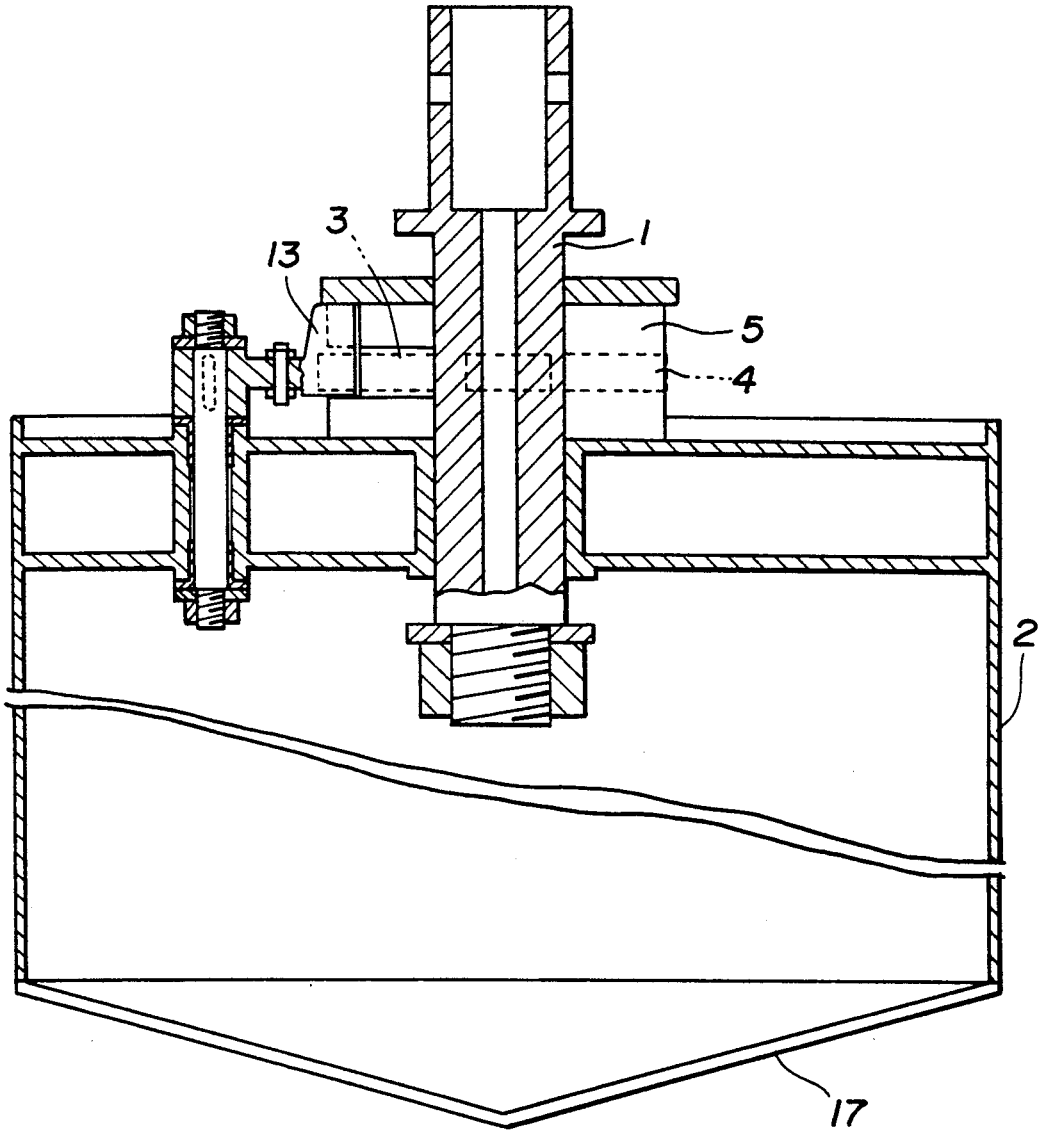
FIG. 9 is a view similar to FIG. 1, showing a second preferred embodiment of the present invention.
Figure 10:
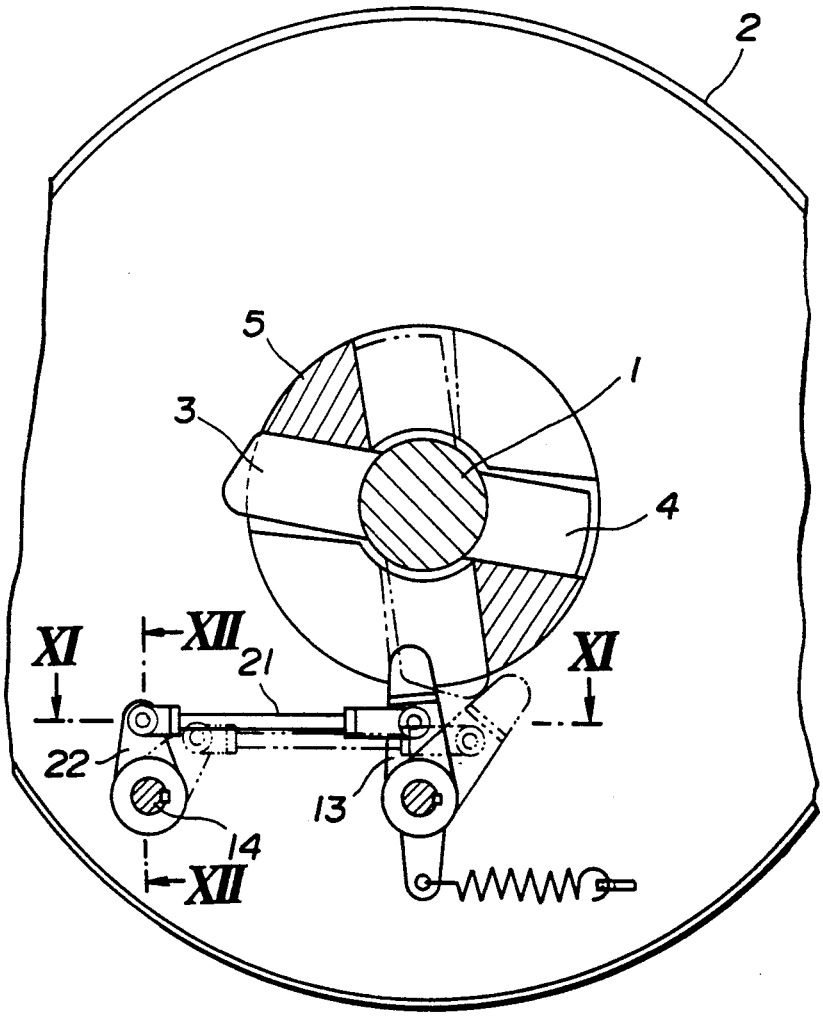
FIG. 10 is a fragmentary cross section showing second preferred embodiment of the present invention.
Figure 11:
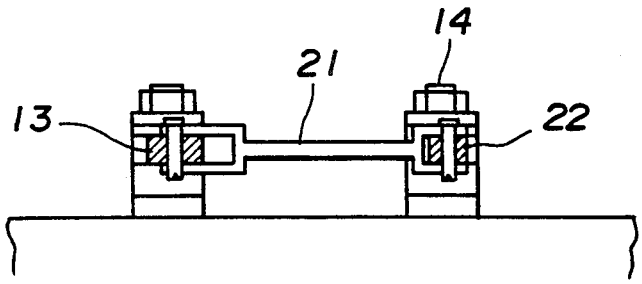
FIG. 11 is a fragmentary longitudinal section taken along the line XI—XI in FIG. 10.
Figure 12:
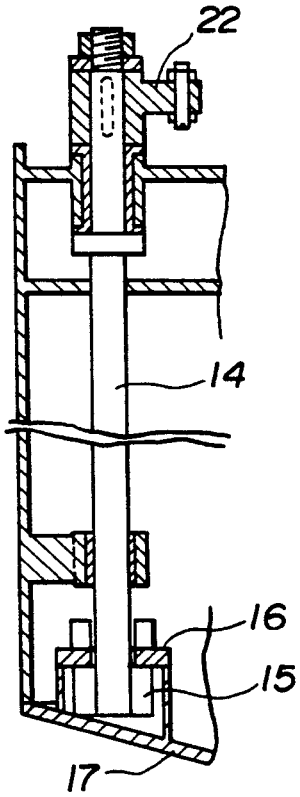
FIG. 12 is a view similar to FIG. 11, taken along the line XII—XII in FIG. 10.
Figure 13:
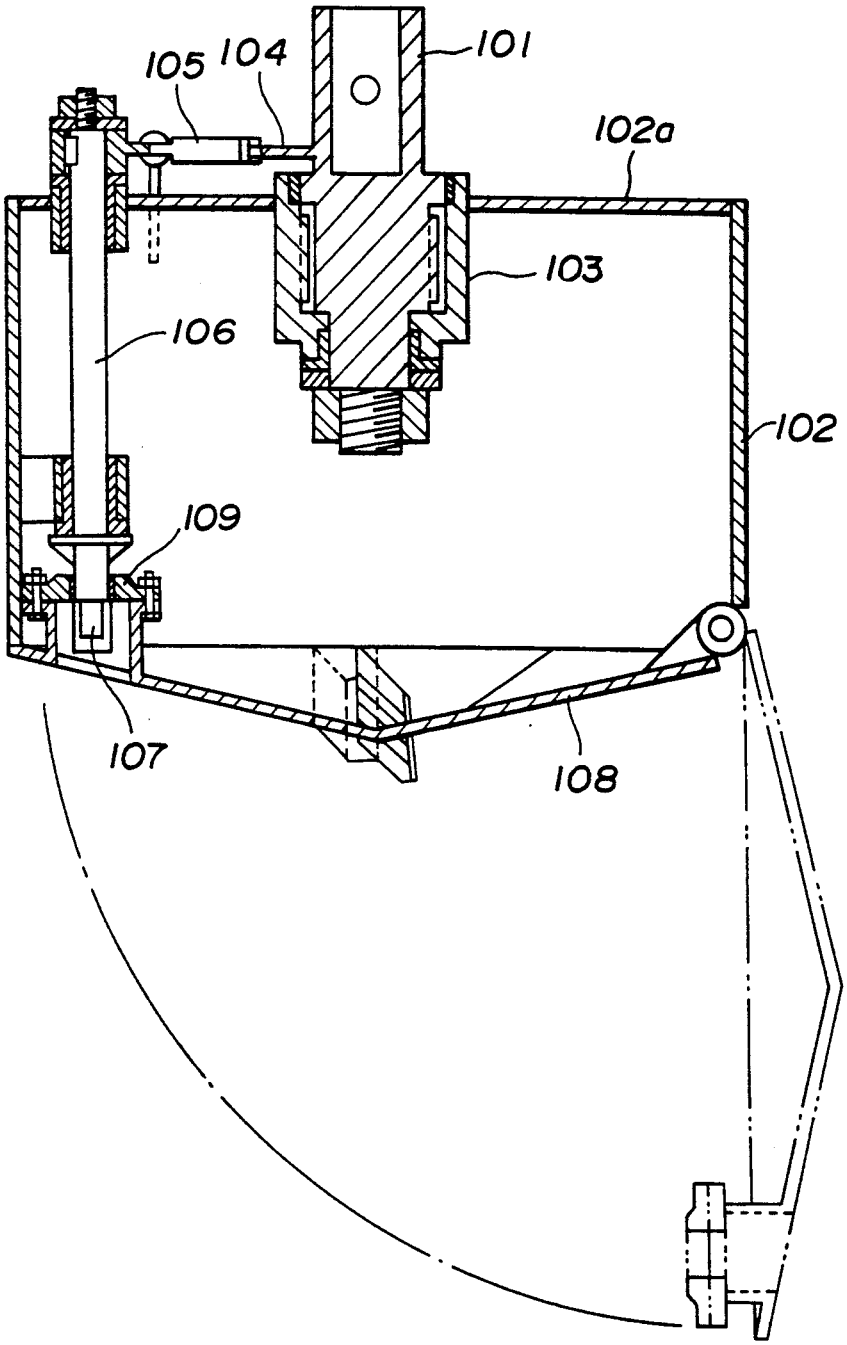
FIG.13 (PRIOR ART)
FIG. 13 is a view similar to FIG. 9, showing a known automatic evacuation drilling bucket.
Figure 14:
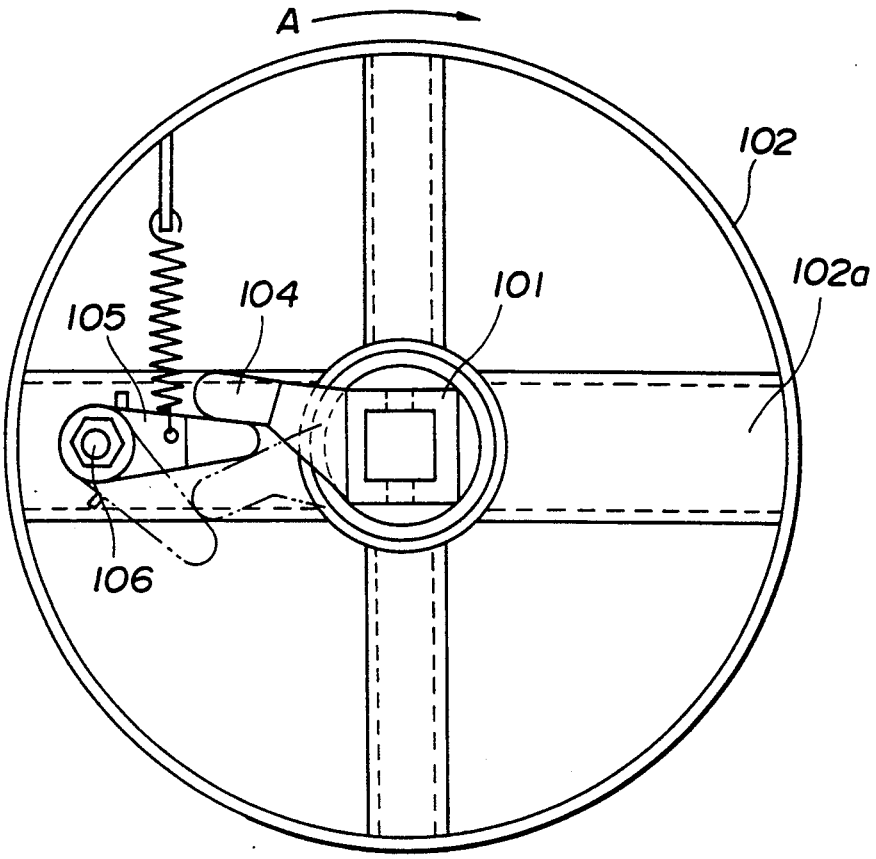
FIG.14 (PRIOR ART)
FIG. 14 is a plan view showing the known automatic evacuation drilling bucket.
Figure 15:
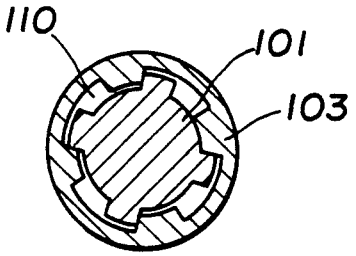
FIG.15 (PRIOR ART)
FIG. 15 is a view similar to FIG. 10, showing a drive shaft member and a follower engaged therewith.

When the drive shaft member 1 is pressed down by the kelly-bar to drill a hole in the ground, it slides in the follower 5, so that the blade member 3 is urged to move into the lower compartment 8 of the working space 6 as indicated by a fully drawn line in FIG. 8, engaging with the follower 5. With rotation of the drive shaft member 1 in the normal direction, the bucket main body 2 is rotated in the normal direction, so that earth and sand are excavated and received within the bucket main body 2. If, during excavation, the bucket main body 2 becomes incapable of rotation by encountering obstacles in the ground, it is preferable to rotate the bucket main body 2 in the reverse direction. This reverse rotation is possible since the blade member 3 is engaged with the follower 5 as described above. In that case, the blade member 3 is located in the lower compartment 8, and is not urged to move into the receiving compartment 11 through the transition compartment 10, so that it fails to rotate the osculating arm 13, keeping the bottom cover 17 locked.

When the bucket main body 2 becomes full of earth and sand as excavated, the drive shaft member 1 is pulled up to lift the bucket main body 2 from the hole for evacuation. Then, the blade member 3 is urged to move into the upper compartment 9 as indicated by a one-dotted chain line in FIG. 8, engaging with the follower 5 likewise. During lifting operation of the bucket main body 2 from the hole, the bucket main body 2 may be locked in the hole by a wall thereof which overhangs the bucket main body 2 due to a soft bed. Under these conditions, it is preferable to rotate the drive shaft member 1 in the normal and reverse directions for release from this local state. In that case also, the blade member 3 fails to rotate the osculating arm 13, keeping the bottom cover 17 locked.

Subsequent to pulling-up from the hole, the bucket main body 2 is softly landed on the ground or a bed of a dump truck. When the drive shaft member 1 is pulled up in being slowly rotated in the reverse direction, the blade member 3 is urged to move from the lower compartment 8 to the receiving compartment 11 through the transition compartment 10 as indicated by a two-dotted chain line in FIG. 8. Under these conditions, the blade member 3 comes in contact with the osculating arm 13 to rotate it clockwise as viewed in FIG. 2. Thus, the stop 15 is disengaged with the receiver 16 through the operating shaft 14, releasing a lock state of the bottom cover 17. When the drive shaft member 1 is pulled up successively, the bottom cover 17 is opened to evacuate earth and sand within the bucket main body 2.

When closing the bottom cover 17, the bucket main body 2 is softly landed on the ground or the bed of the dump truck. This moves the blade member 3 from a position as indicated by a broken line in FIG. 8 to a position as indicated by the two-dotted chain line in FIG. 8. Subsequently, when the drive shaft member 1 is rotated rightward, the blade member 3 is urged to move in the direction of the upper and lower compartments 9, 8 through the transition compartment 10. Thus, as shown in FIGS. 1 and 2, the osculating arm 3 is returned by a spring 19 to a position as indicated by a fully drawn line in FIG. 2 from a position as indicated by a two-dotted line in FIG. 2, and the stop 15 is engaged with the receiver 16 to lock the bottom cover 17. If earth, sand or the like is found between the bottom cover 17 and the bucket main body 2, the stop 15 is not rotated even though the blade member 3 is urged to move in the aforementioned direction, obtaining no lock of the bottom cover 17. Therefore, when suspending the bucket main body 2, the bottom cover 17 is opened. In that case, the bucket main body 2 is landed again on the ground or the bed of the dump truck to rotate the stop 15 up to a position of the stop hole 16*a* of the receiver 16 along a bevel of the guide portion 16*b* (see FIGS. 7*a* and 7*b*), obtaining lock of the bottom cover 17.

If lock is incomplete, the bucket main body 2 is lifted to open the bottom cover 17. At that time, the stop 15 is held in its engagement position by a spring, so that without the guide portion 16*b*, soft landing of the bucket main body 2 fails to allow engagement of the stop 15 with the receiver 16, i.e., lock of the bottom cover 17, due to a positional difference between the stop 15 and the stop hole 16*a* of the receiver 16. To obtain this engagement, the blade member 3 should be urged to move in the direction opposite to the aforementioned direction, and softly landed again, resulting in a complicated operation. However, due to existence of the guide portion 16*b*, a positional adjustment of the stop 15 by rotating the blade member 3 is unnecessary, resulting in a simple operation.

Referring to FIGS. 9–12, there is shown a second preferred embodiment of an automatic evacuation drilling bucket. The second preferred embodiment is substantially similar to the first preferred embodiment except that the bucket main body 2 is large in size. Since the lock mechanism for locking the bottom cover 17 to bucket main body 12 is disposed also, preferably, at the marginal portion of the bottom cover 17, the osculating arm 13 is connected to the operating shaft 14 by a connecting rod 21 and an auxiliary arm 22.

What is claimed is:

1. A drilling bucket including a drive shaft member for receiving a torque from a kelly-bar and a main body mounted to the drive shaft member and having a bottom cover, the drive shaft member being rotatable in a normal direction and a reverse direction, comprising:

a blade member fixedly mounted to the drive shaft member for rotating together;

a follower disposed to the main body, said follower being formed with a space for receiving said blade member;

an arm rotatably mounted to the main body, said arm being capable of coming in contact with said blade member to open the bottom cover of the main body;

first means for allowing an engagement of said blade member with said follower when the drive shaft member is rotated in the normal direction and the reverse direction; and second means for allowing a contact of said blade member with said arm when the drive shaft member is rotated in the reverse direction.

2. A drilling bucket as claimed in claim 1, wherein said first means include upper and lower compartments of said space of said follower.

3. A drilling bucket as claimed in claim 1, wherein said second means include transition and receiving compartments of said space of said follower.

4. A drilling bucket as claimed in claim 1, wherein said arm is provided with a connecting rod and an auxiliary arm.

* * * * *